US006702724B2

(12) United States Patent
Taylor et al.

(10) Patent No.: US 6,702,724 B2
(45) Date of Patent: Mar. 9, 2004

(54) HAMSTRING EXERCISE MACHINE

(75) Inventors: Vincent Anthony Taylor, 20160 NW. 9th Dr., Pembroke Pines, FL (US) 33029; Michael M. Anthony, Parkland, FL (US)

(73) Assignee: Vincent Anthony Taylor, Pembroke Pines, FL (US)

( * ) Notice: Subject to any disclaimer, the term of this patent is extended or adjusted under 35 U.S.C. 154(b) by 257 days.

(21) Appl. No.: 09/870,249

(22) Filed: May 30, 2001

(65) Prior Publication Data

US 2002/0183171 A1 Dec. 5, 2002

(51) Int. Cl.[7] ..... A63B 21/062; A63B 23/04

(52) U.S. Cl. ..... 482/101; 482/52; 482/79; 482/135

(58) Field of Search ..... 482/51–52, 93–96, 482/101, 70, 79, 95, 98, 99, 135, 139, 141, 97

(56) References Cited

U.S. PATENT DOCUMENTS

| | | | | | |
|---|---|---|---|---|---|
| 4,659,075 | A | * | 4/1987 | Wilkinson | 482/52 |
| 4,809,973 | A | * | 3/1989 | Johns | 482/99 |
| 4,846,458 | A | * | 7/1989 | Potts | 482/26 |
| 5,011,139 | A | * | 4/1991 | Towley, III | 482/38 |
| 5,201,694 | A | * | 4/1993 | Zappel | 482/133 |
| 5,322,489 | A | * | 6/1994 | Webb et al. | 482/38 |
| 5,499,959 | A | * | 3/1996 | Holmes et al. | 482/95 |
| 5,554,083 | A | * | 9/1996 | Chen | 482/95 |
| 5,951,445 | A | * | 9/1999 | Vittone et al. | 482/101 |
| 2002/0098959 | A1 | * | 7/2002 | Florek | 482/141 |

OTHER PUBLICATIONS

Nautilus Weight–Assisted Chin–Up/Dip, Making America Stronger product brochure, 1994.*

CYBEX Assist Dip/Chin, Strength Systems product brochure, 1994.*

Body Masters MD 215 Selectorized Chin & Dip, product brochure, 1994.*

CYBEX GS–CDS Assisted Chin–Up/Dip, Commercial Strength Systems product brochure, p. 20, 2000.*

Gym 80 International Bro 08002 Glutens 5 pages.

* cited by examiner

*Primary Examiner*—Nicholas D. Lucchesi
*Assistant Examiner*—Victor Kenny Hwang
(74) *Attorney, Agent, or Firm*—Oltman, Flynn & Kubler

(57) ABSTRACT

An exercise machine for exercising the hamstrings includes at least one weight; a weight support surface below the weight; an upright weight guide shaft laterally spaced apart from the weight; a weight displacement pedal slidably mounted to the pedal guide shaft; a machine frame; a generally horizontal pulley axle secured to the machine frame at a position higher than the weight and higher than the weight displacement pedal and laterally between the weight and the pedal guide shaft; a pulley mounted on the pulley axle so that the pulley is rotatable relative to the machine frame; a cable extending over and riding on the pulley and having a cable distal end secured to the weight and having a cable proximal end secured to the weight displacement pedal, the cable being of a length so that when the weight rests on the weight support surface the weight displacement pedal is elevated.

15 Claims, 18 Drawing Sheets

HAMSTRING EXERCISE MACHINE

BACKGROUND OF THE INVENTION

1. Field of the Invention

The present invention relates generally to the field of exercise equipment. More specifically the present invention relates to an exercise machine for exercising the hamstrings, the machine having at least one movement resistance weight and a weight support surface positioned below the weight, a weight displacement pedal slidably mounted to an upright pedal guide shaft, a machine frame and a pulley rotatably mounted on a pulley axle secured relative to the machine frame at a position above the at least one lifting weight and also above the weight displacement pedal, a cable having a cable distal end secured to the weight and having a cable proximal end secured to the weight displacement pedal, the cable being of a length relative to the elevation of the pulley such that when the weight is resting on the weight support surface the pedal is elevated above its rest position. The pedal preferably includes a pedal brake biased with brake engagement biasing means which engages the pedal guide shaft when at rest and which releases the pedal guide shaft upon application of downward force to the pedal against the biasing of the brake engagement biasing means, so that when the pedal is released, the brake engages the pedal guide shaft and prevents the weight from falling.

2. Description of the Prior Art

There have long been weight machines for exercising various muscles of the human body. Many of these have included stacks of discrete and separable weight plates, any desired number of which can be lifted by means of levers or pulleys. A problem with these prior machines has been that none have been suited to exercising the hamstrings and the muscles to which the hamstrings connect. Another problem has been that a sudden release of the weight plates causes the plates to fall freely and crash into plates or a support structure below the stack, causing potential damage to the machine, to the gym floor, and to the user if the falling weight plates should cause a pedal or grip to fly into high impact contact with his or her body.

It is thus an object of the present invention to provide an exercise machine which is configured to permit full range exercise of the hamstrings.

It is another object of the present invention to provide such an exercise machine which includes weight stack brake means to prevent suddenly released raised weight plates from falling and crashing into a plate or structure below the raised plates, and the resulting sudden displacement of pedals and grip handles.

It is still another object of the present invention to provide such an exercise machine which is compact and readily transported.

It is finally an object of the present invention to provide such an exercise machine which is safe, reliable, simple in construction and relatively inexpensive to manufacture.

SUMMARY OF THE INVENTION

The present invention accomplishes the above-stated objectives, as well as others, as may be determined by a fair reading and interpretation of the entire specification.

An exercise machine is provided for exercising the hamstrings, including at least one weight; a weight support surface below the weight; an upright weight guide shaft laterally spaced apart from the weight; a weight displacement pedal slidably mounted to the pedal guide shaft; a machine frame; a generally horizontal pulley axle secured to the machine frame at a position higher than the weight and higher than the weight displacement pedal and laterally between the weight and the pedal guide shaft; a pulley mounted on the pulley axle so that the pulley is rotatable relative to the machine frame; a cable extending over and riding on the pulley and having a cable distal end secured to the weight and having a cable proximal end secured to the weight displacement pedal, the cable being of a length so that when the weight rests on the weight support surface the weight displacement pedal is elevated.

The exercise machine preferably additionally includes a pedal brake positioned adjacent to the pedal guide shaft and biased with a brake engagement biasing mechanism to engage the pedal guide shaft and including a brake disengagement mechanism operatively connected to the pedal which releases the pedal guide shaft upon application of downward force on the weight displacement pedal against the biasing of the brake engagement biasing mechanism. The machine frame preferably includes a parallelepipped structure having a generally horizontal rectangular base frame, a generally horizontal rectangular top frame spaced above the base frame and laterally spaced apart upright frame posts interconnecting the base frame and the top frame. The frame posts preferably include a first proximal frame post and a first distal frame post and a second proximal frame post and a second distal frame post. The exercise machine preferably additionally includes a first pulley mounting member interconnecting and secured to the first proximal frame post and the first distal frame post, and a second pulley mounting member interconnecting and secured to the second proximal frame post and the second distal frame post, where the pulley axle extends between and is secured relative to the first pulley mounting member and the second pulley mounting member and passes through the center of the pulley, the pulley being positioned between the first pulley mounting member and the second pulley mounting member.

The pedal guide shaft preferably extends between and is secured to the base frame and the top frame. The at least one movement resistance weight preferably includes a weight guide port and is slidably mounted on an upright weight guide shaft extending through the weight guide port, the weight guide shaft extending between and being secured to the base frame and the top frame. The at least one movement resistance weight preferably includes a stack of discrete and separable weight plates and an upright plate engaging rod connected the cable distal end and having a longitudinal series of weight key passing holes, the engaging rod extending through registering engaging rod ports in the weight plates, and a weight key fitted underneath a given number of the weight plates selected for lifting in a given workout and into a corresponding engaging rod port. The exercise machine preferably additionally includes a housing cover fitted over the machine frame upper end and around the pulley to protect a user from injurious contact with the pulley and the cable.

The exercise machine preferably additionally includes a substantially horizontal base plate resting on the ground beneath the pedal, and base plate legs secured to the base plate and extending upwardly, and leg brackets connecting the base plate legs to two opposing frame posts.

The exercise machine preferably still additionally includes first and second grip handles secured relative to and extending from the frame upper end, above the weight displacement pedal. The exercise machine preferably still additionally includes a first grip arm connected to the first grip handle and a second grip arm connected to the second grip handle, the first and second grip arms extending forwardly from the frame; first and second grip arm support structures including a structure for receiving and slidably passing the first and second grip arms respectively and including a structure for securing the first and second grip arms at any of various forward extensions.

Each grip arm preferably includes a longitudinally extending grip arm keyway and wherein each grip arm support structure includes a grip arm key which fits into the corresponding the grip arm keyway for preventing rotation of each grip arm about its longitudinal axis while permitting each grip arm to slide longitudinally within the corresponding grip arm support structure.

The weight displacement pedal preferably includes a tubular pedal support arm formed of telescoping proximal and distal pedal support arm segments, where the weight displacement pedal is secured to the proximal pedal support arm segment and the cable proximal end is secured to the distal pedal support arm segment, the pedal distal support arm segment including a pedal guide tube slidably fitting around the pedal guide shaft, and including a mechanism for releasibly securing the proximal pedal support arm segment relative to the distal pedal support arm segment.

BRIEF DESCRIPTION OF THE DRAWINGS

Various other objects, advantages, and features of the invention will become apparent to those skilled in the art from the following discussion taken in conjunction with the following drawings, in which:

FIG. 17*a* is a partial view of the machine frame, showing pedal guide shaft engaging elements of the brake mechanism.

DETAILED DESCRIPTION OF THE PREFERRED EMBODIMENTS

Figure 1:
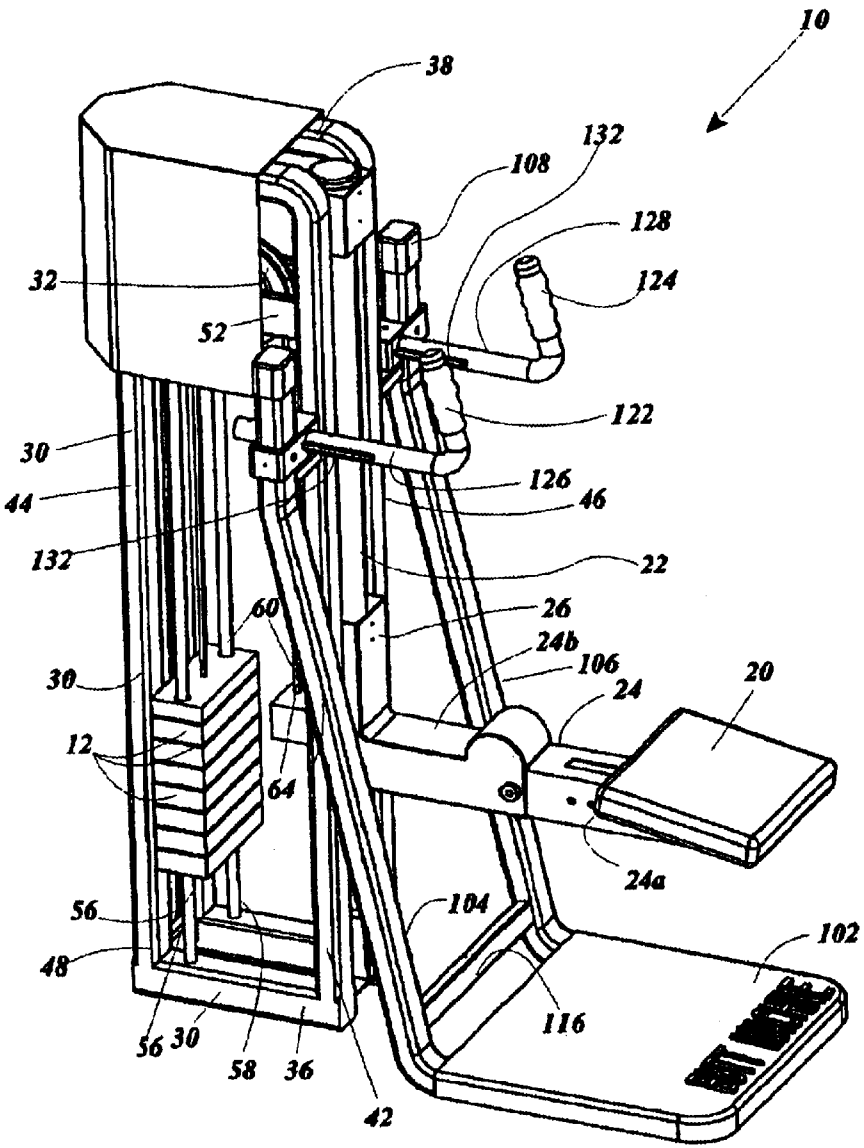
FIG. 1 is a perspective side view of the preferred embodiment of the exercise machine.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
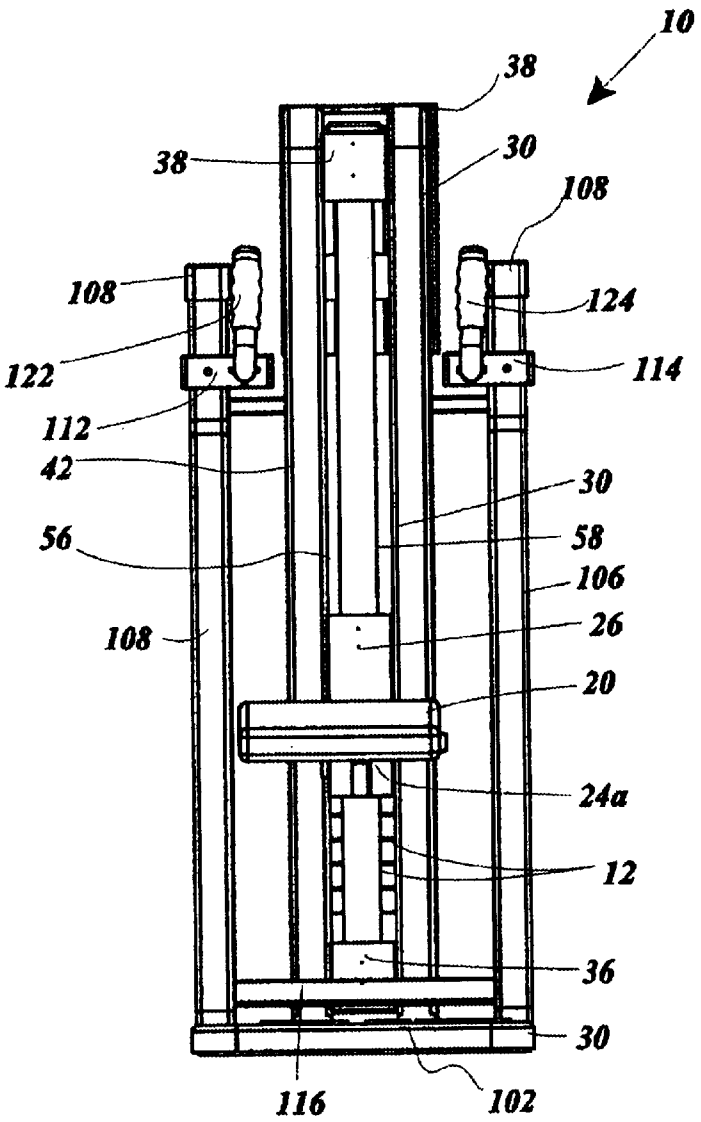
FIG. 2 is a front view of the exercise machine of FIG. 1.
Figure 3:
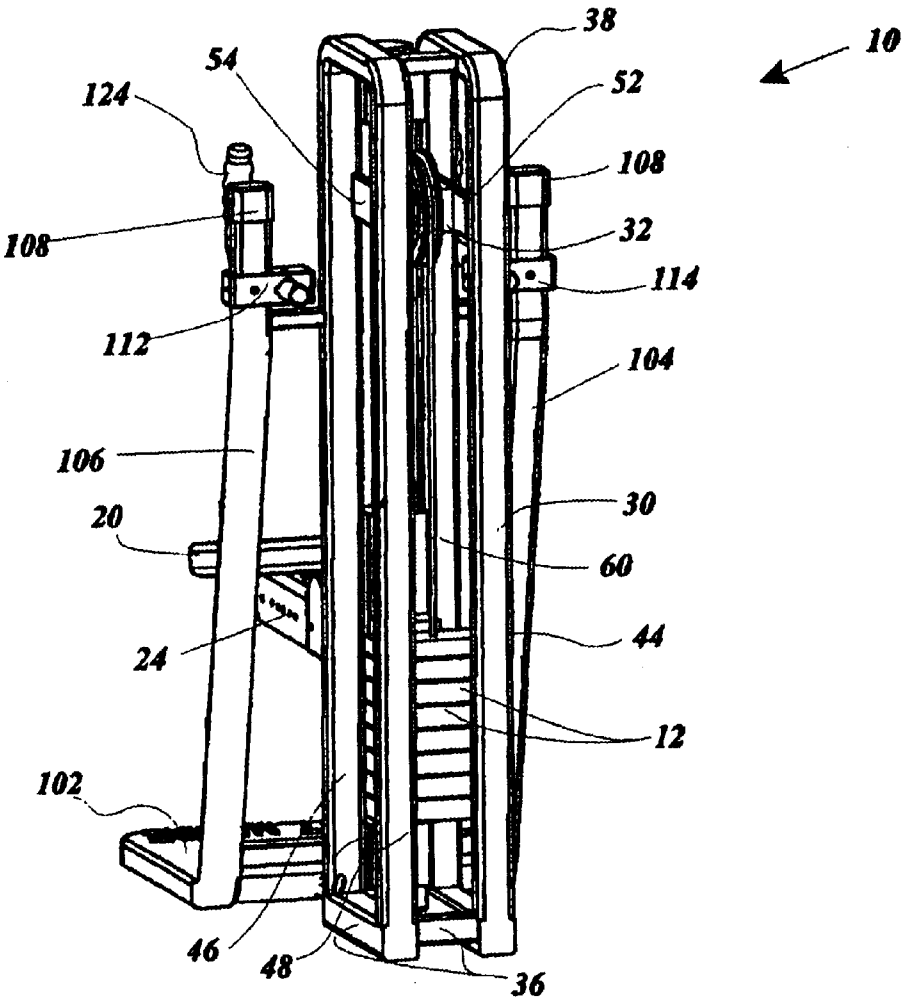
FIG. 3 is a perspective rear view of the machine of FIG. 1.
Figure 4:
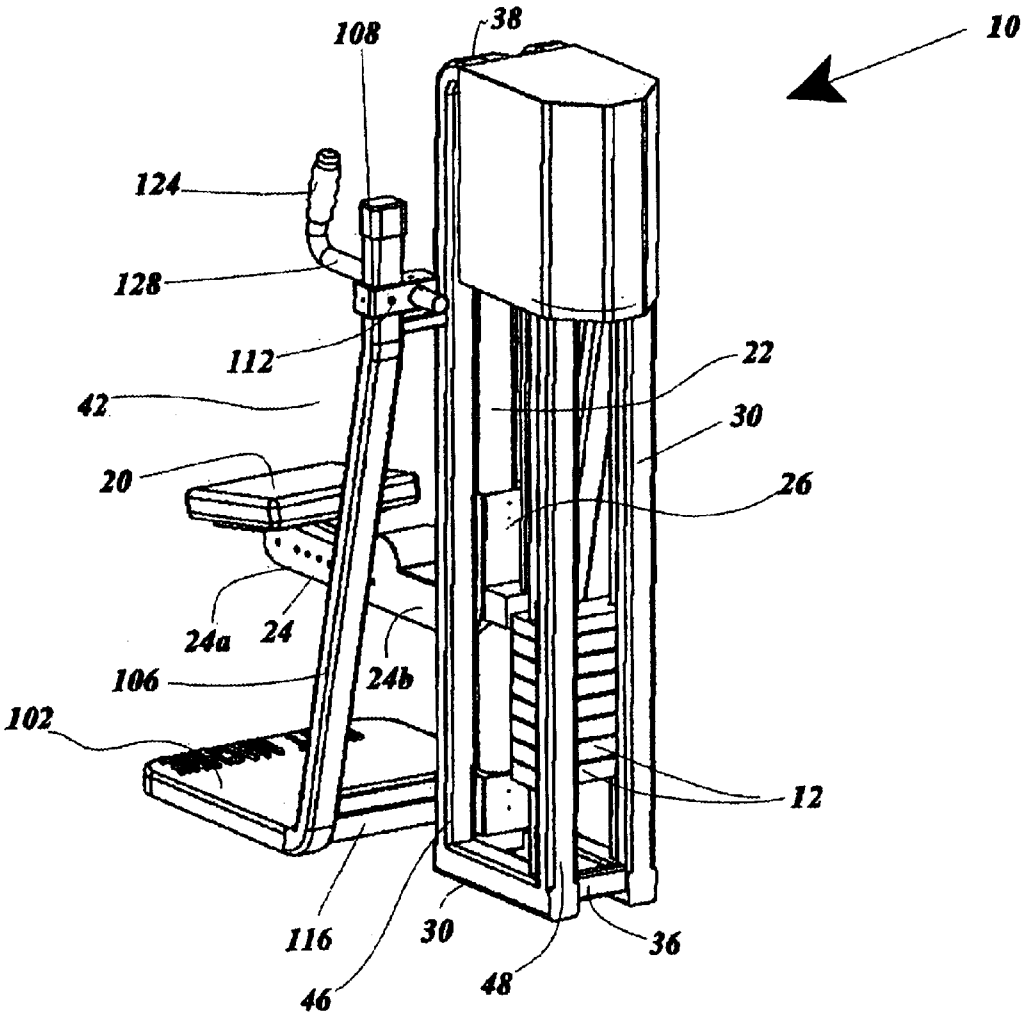
FIG. 4 is a view as in FIG. 3 with the housing cover removed.
Figure 5:
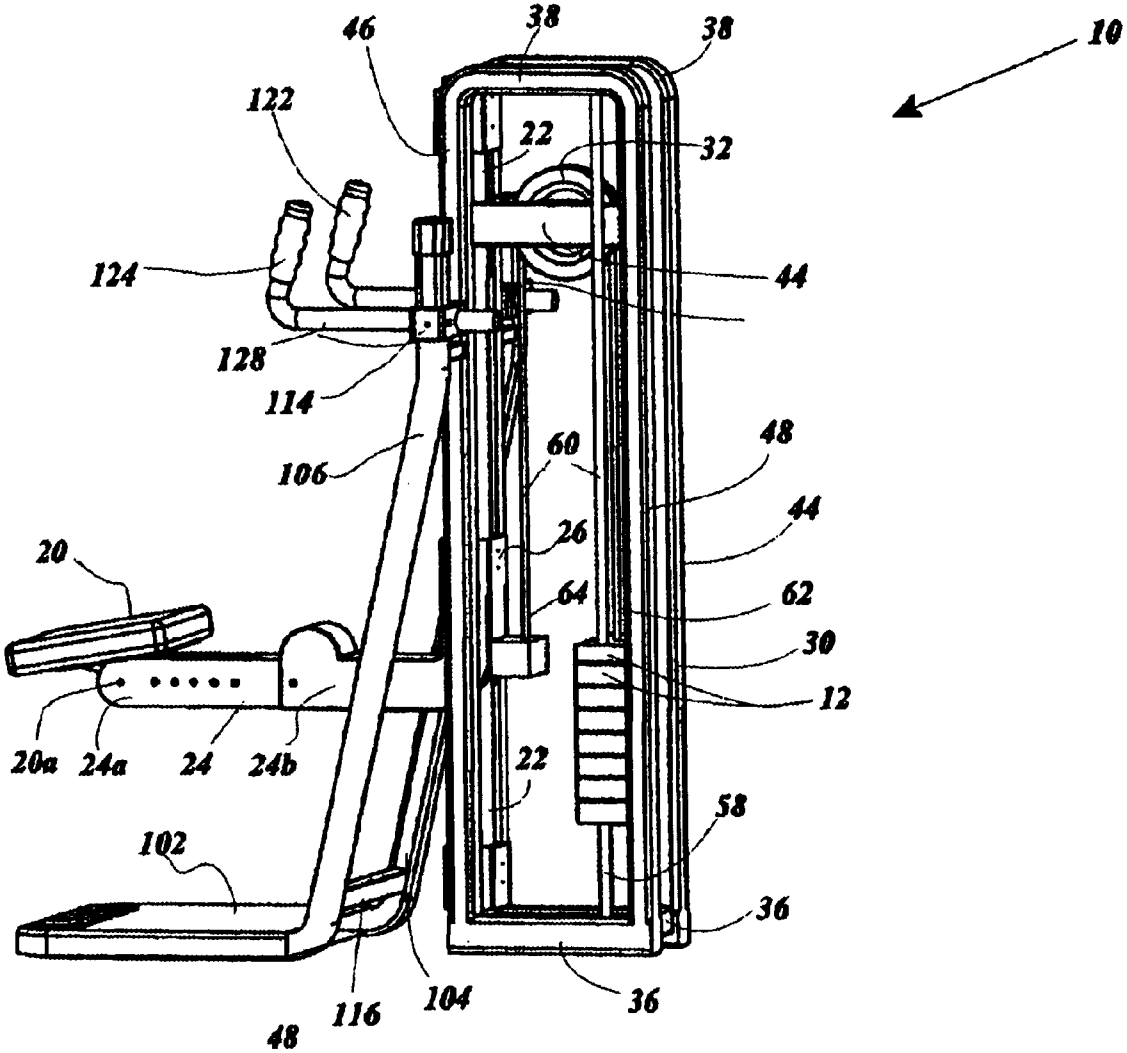
FIG. 5 is a side view of the machine of FIG. 4, revealing details of the pulley and cable structures.
Figure 6:
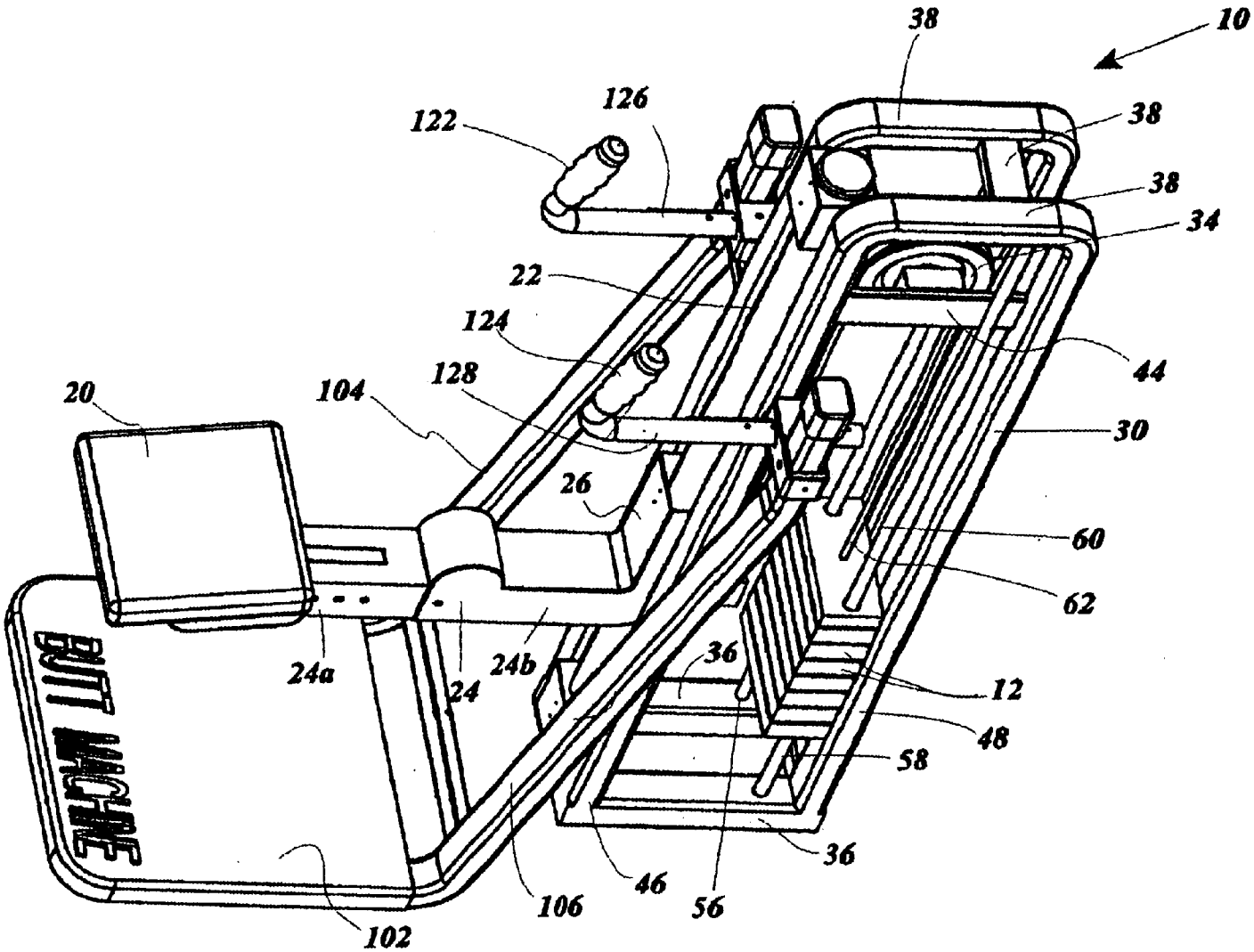
FIG. 6 is a perspective top view of the machine of FIG. 4.
Figure 7:
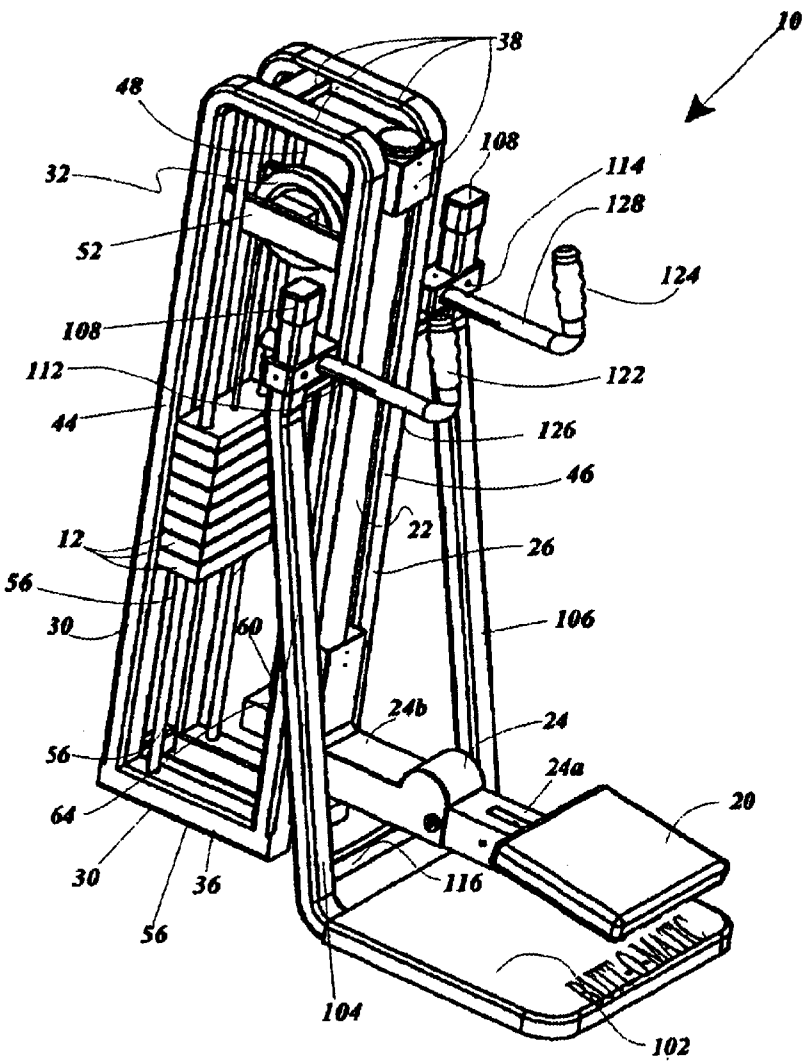
FIG. 7 is a perspective side view of the machine of FIG. 4, showing the weight displacement pedal depressed and the weight stack lifted by the cable.
Figure 8:
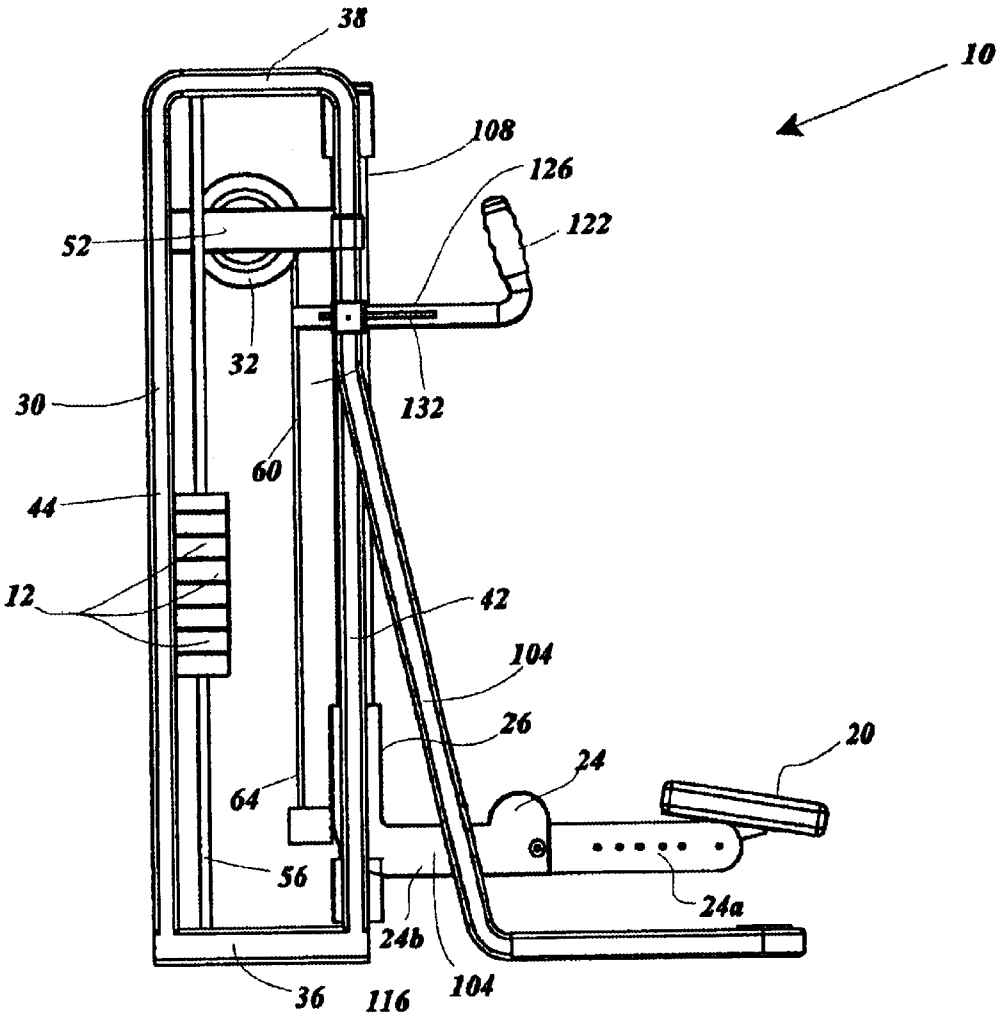
FIG. 8 is a side view of the machine of FIG. 7, once again showing the weight stack elevated.
Figure 9:
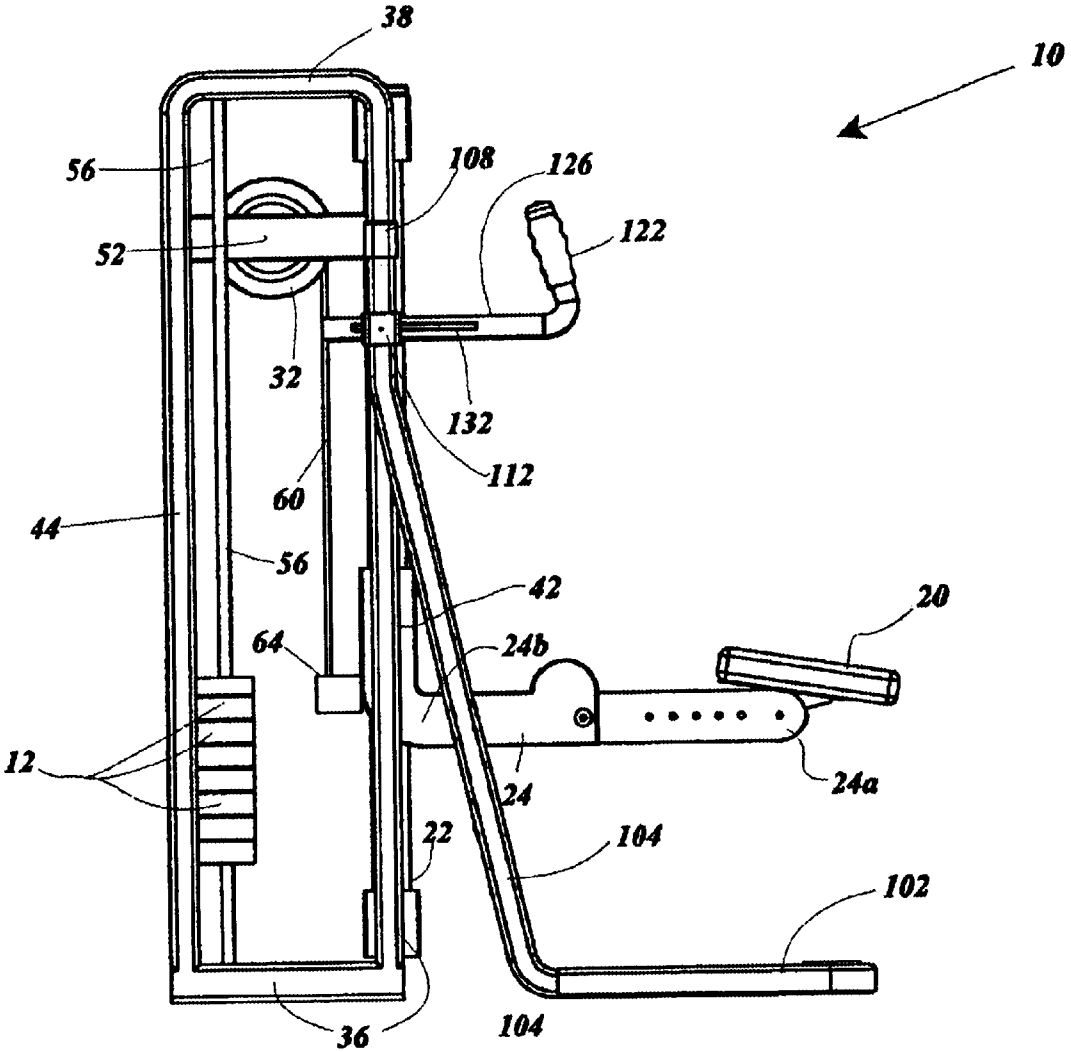
FIG. 9 is side view as in FIG. 8 with the weight stack lowered to its rest position and the pedal elevated to its rest position.
Figure 10:
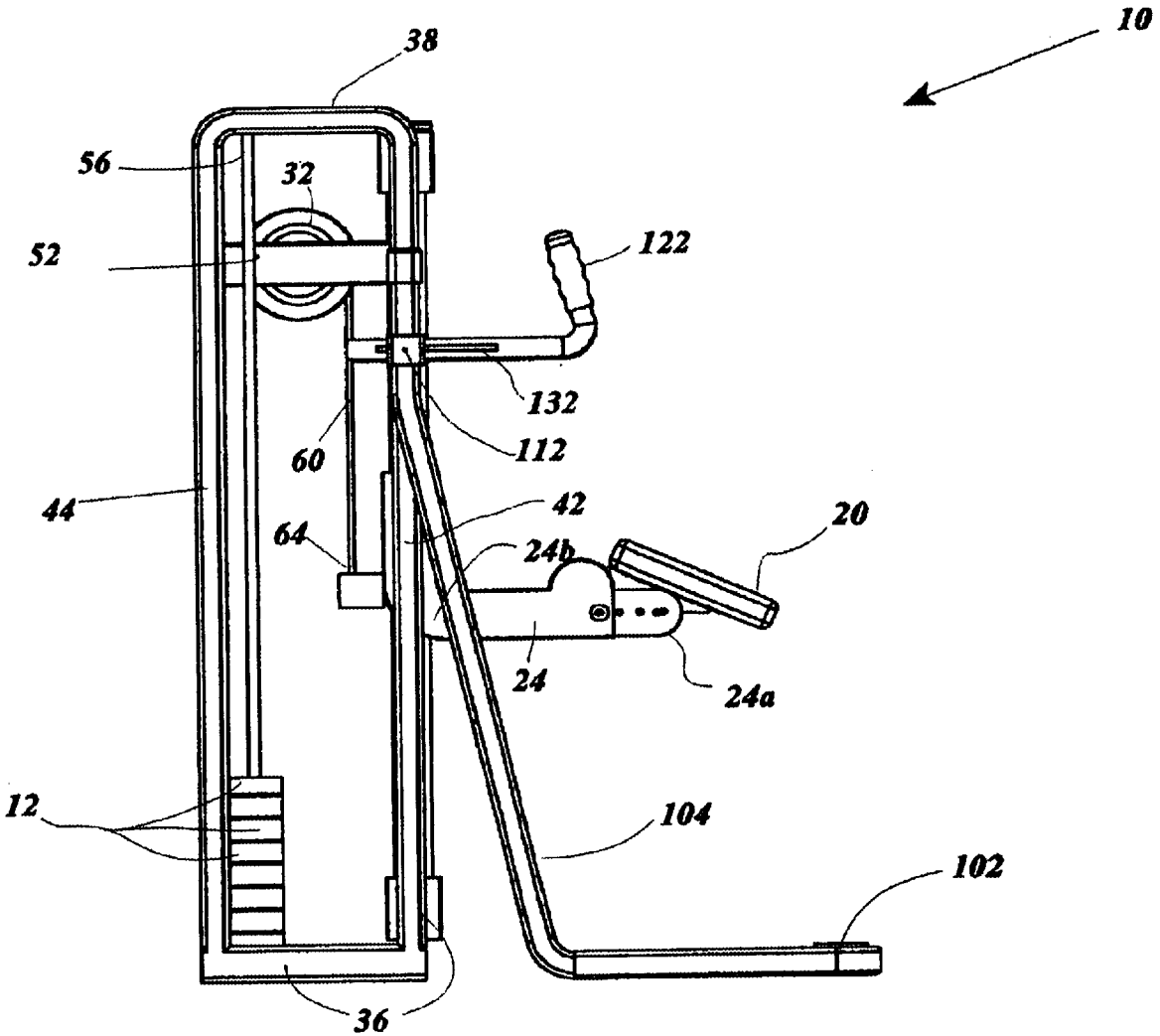
FIG. 10 is a side view as in FIG. 9, showing the pedal arm telescoped to a contracted configuration.
Figure 11:
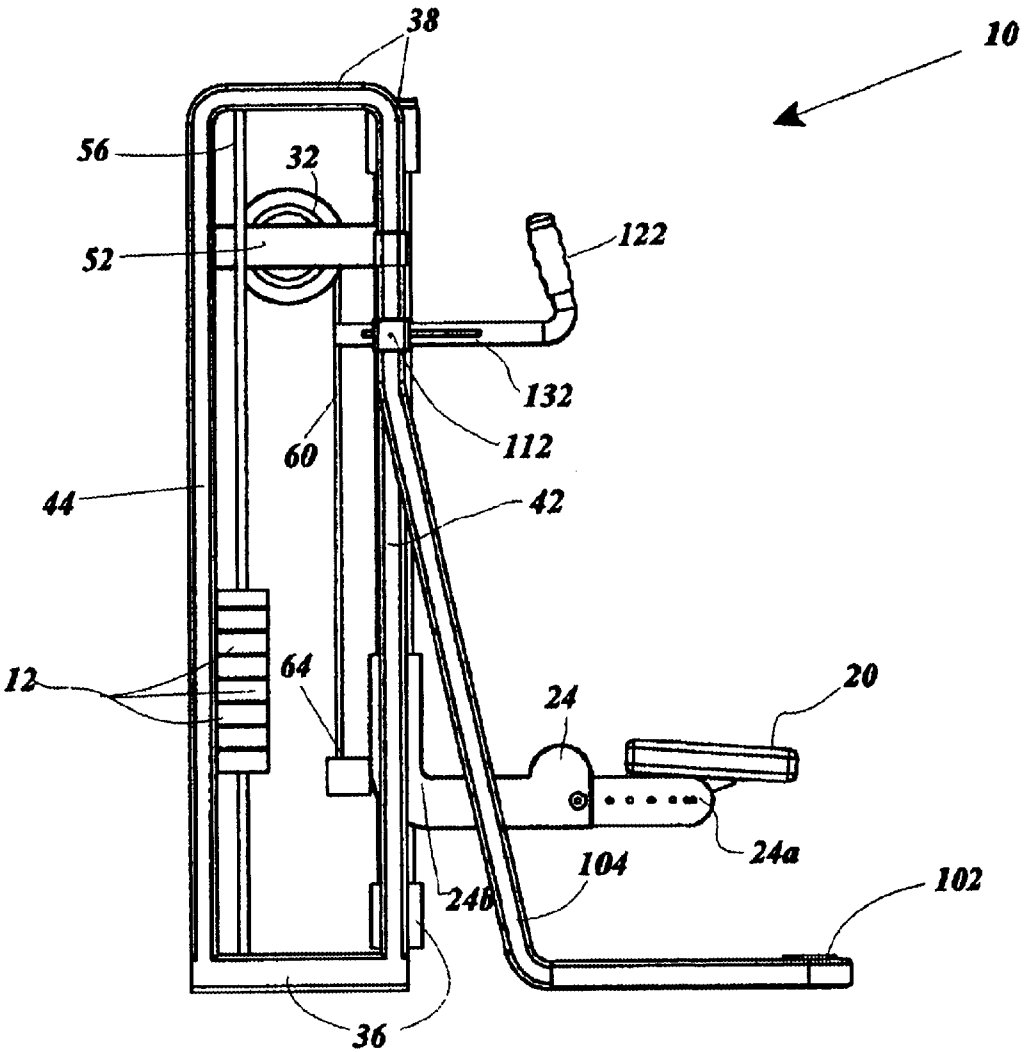
FIG. 11 is a side view as in FIG. 10, with the weight stack elevated and secured in its elevated position by the machine brake.
Figure 12:
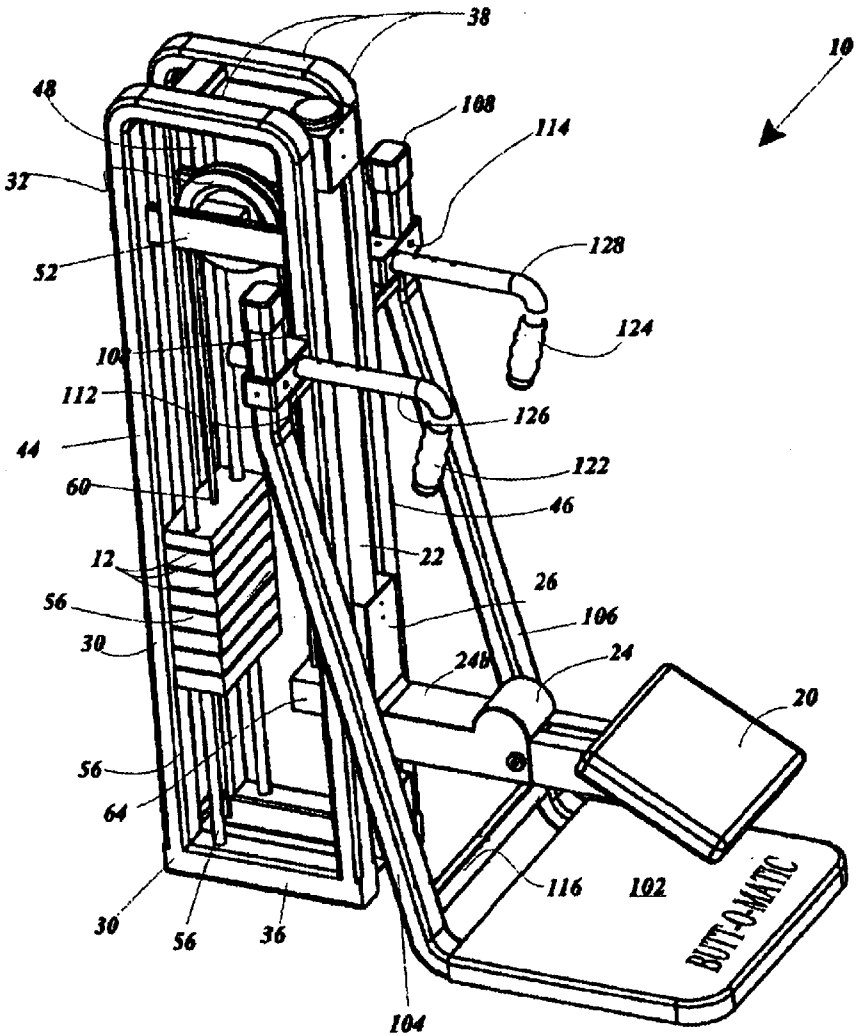
FIG. 12 is a perspective view of the machine positioned as in FIG. 11.
Figure 13:
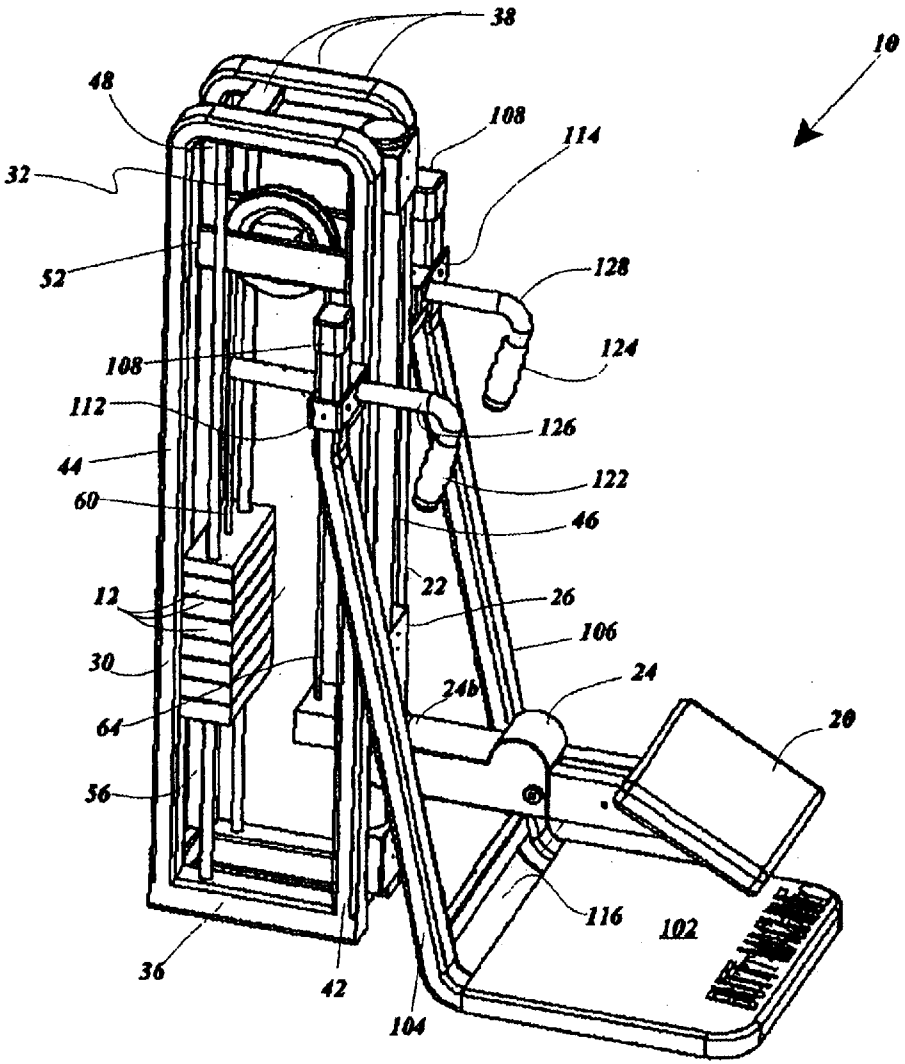
FIG. 13 is a view as in FIG. 12.
Figure 14:
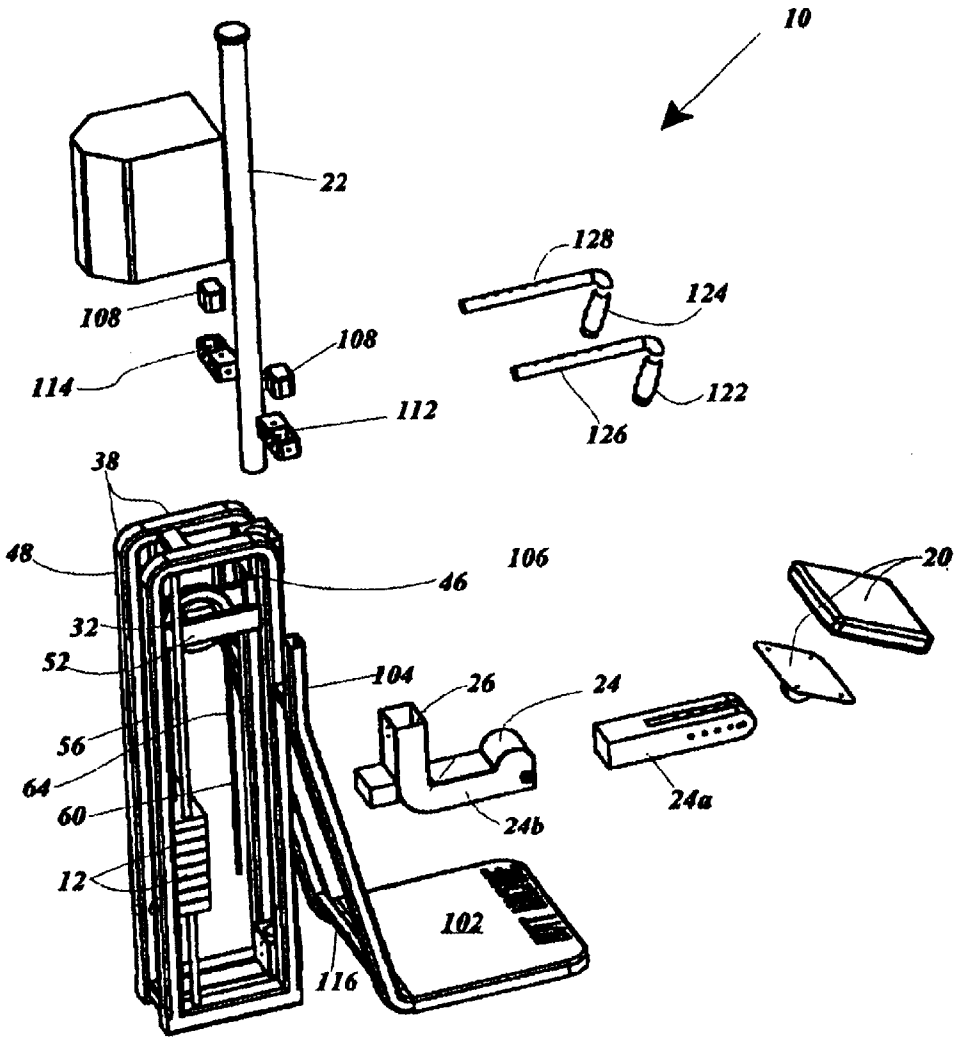
FIG. 14 is a perspective exploded view of the apparatus, revealing its various operational elements and their spacial relationships.
Figure 15:
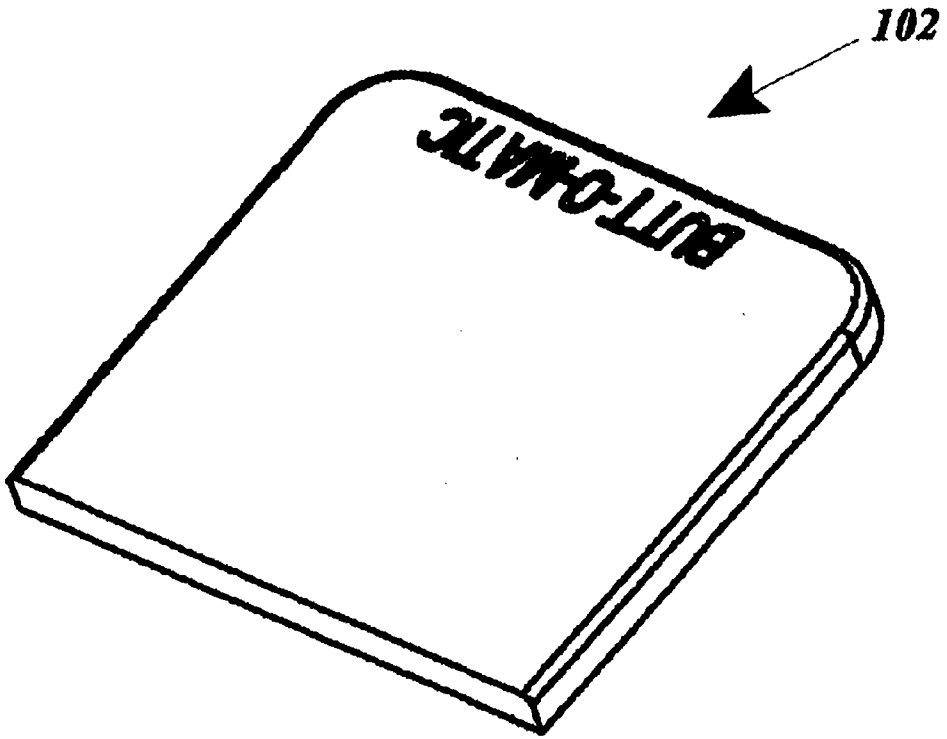
FIG. 15 is a perspective view of the horizontal base plate.
Figure 16:
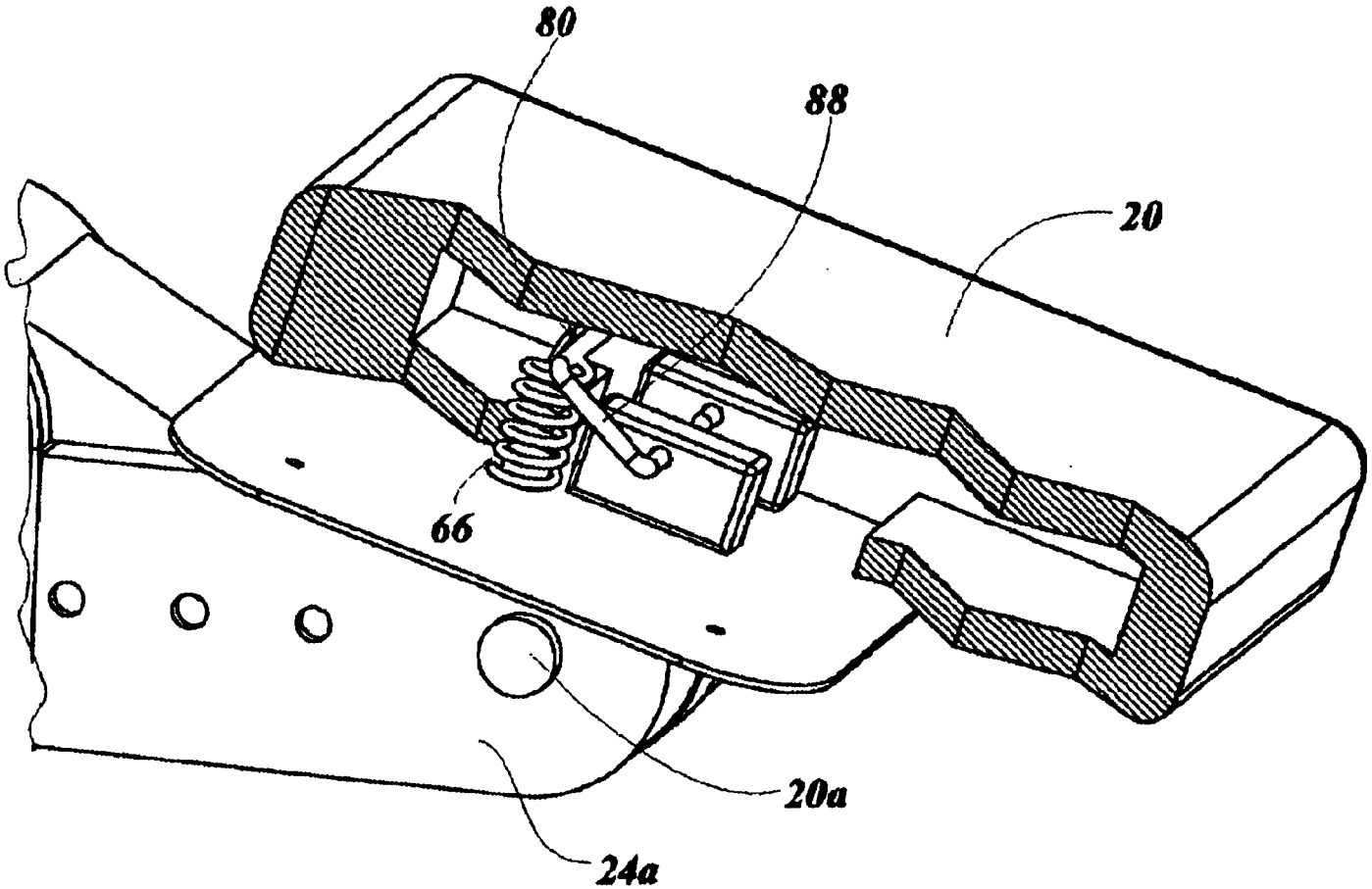
FIG. 16 is broken away side view of the inventive pedal portion of the brake engagement biasing means of the brake mechanism.
Figure 17:
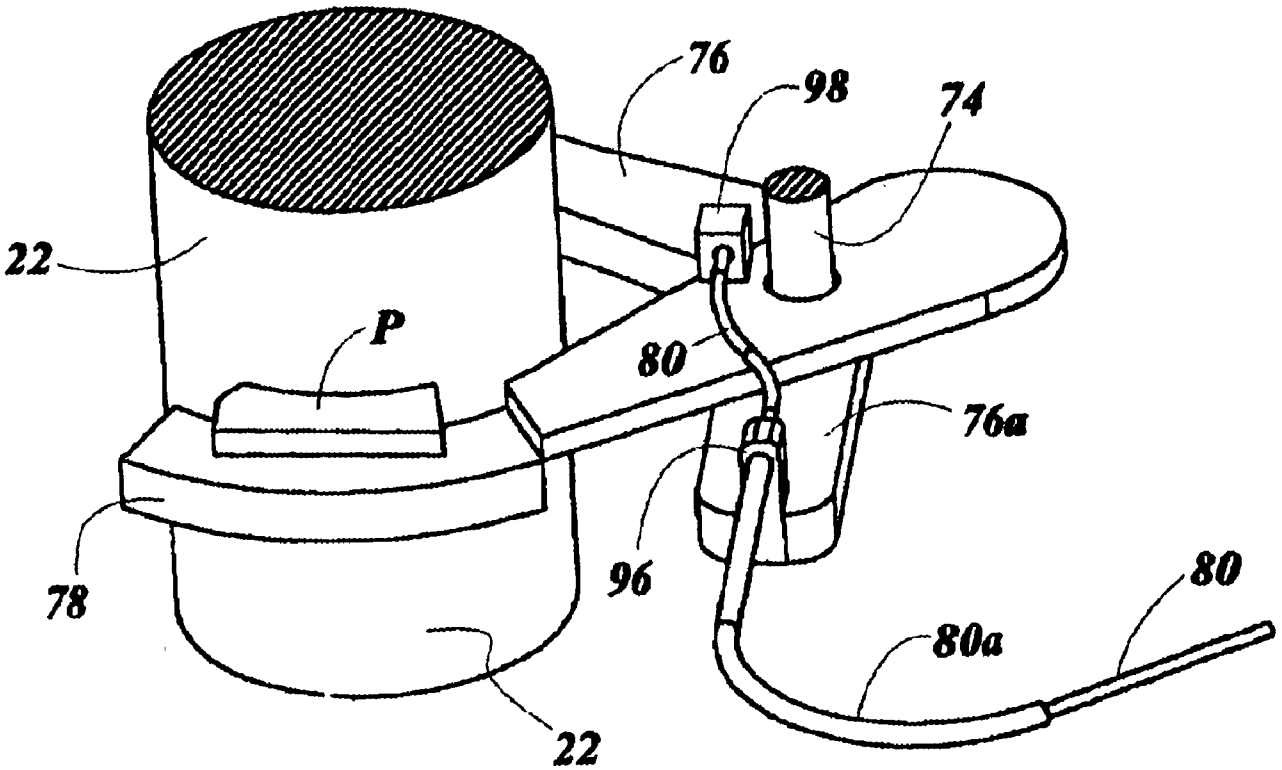
FIG. 17 is a detailed, perspective view of the elements making up the brake mechanism.
Figure 18:
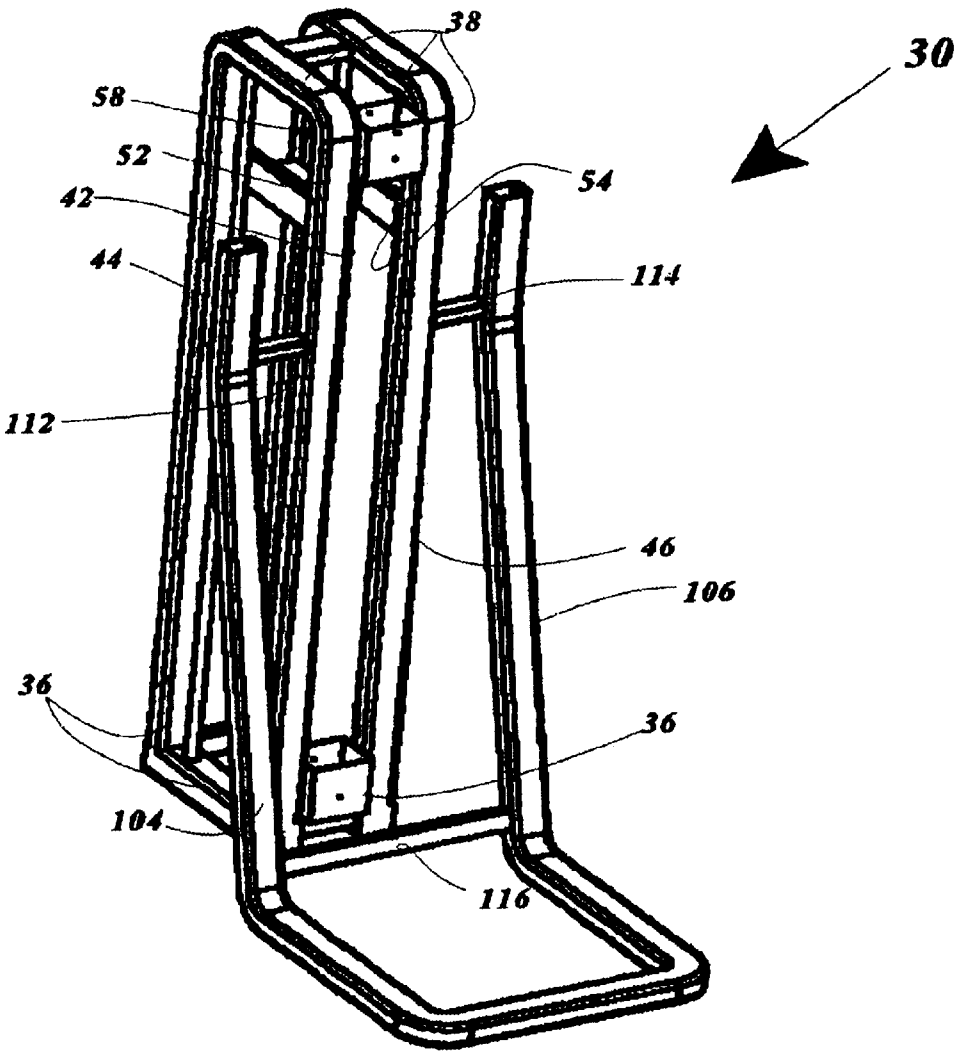
FIG. 18 is a front perspective view of the machine frame and the base plate legs and leg brackets.

Referring to FIGS. 1–18, an exercise machine 10 is disclosed for exercising the hamstrings, the machine 10 having at least one movement resistance weight 12 and a weight support surface 14 below the weight 12, a weight displacement pedal 20 slidably mounted to an upright pedal guide shaft 22, a machine frame 30 and a pulley 32 rotatably mounted on a pulley axle 34 secured to the machine frame 30 at a position above the lifting weight 12 and above the weight displacement pedal 20, a cable 60 extending over and riding on pulley 32, having a cable distal end 62 secured to the weight 12 and having a cable proximal end 64 secured to weight displacement pedal 20, the cable 60 being of a length relative to the elevation of pulley 32 such that when the weight 12 is resting on weight support surface 14 the pedal 20 is elevated. The pedal 20 preferably includes a pedal brake 70 biased with brake engagement biasing means 72 which engages the pedal guide shaft 22 when pedal 20 is at rest, and which releases the pedal guide shaft 22 upon application of downward force onto pedal 20 against the biasing of the brake engagement biasing means 72.

Machine frame 30 preferably includes a parallelepipped structure having a generally horizontal rectangular base frame 36, a generally horizontal rectangular top frame 38 spaced above base frame 36 and four upright frame posts interconnecting the corners of base frame 36 and top frame 38. The frame posts include a first proximal frame post 42 and a first distal frame post 44 and a second proximal frame post 46 and a second distal frame post 48. The members making up machine frame 30 are preferably tubular for reduced machine 10 weight. A first pulley mounting member 52 extends from the first proximal frame post 42 to the first distal frame post 44 and a second pulley mounting member 54 extends from the second proximal frame post 46 to the second distal frame post 48. The pulley axle 34 extends between and is secured to the first and second pulley mounting members 52 and 54, respectively, and through the center of pulley 32 which is positioned between first and second pulley mounting members 52 and 54. The pedal guide shaft 22 is preferably circular in cross-section and extends between and is secured to the base frame 36 and to the top frame 38.

The weight 12 preferably has two weight guide ports 16 and is slidably mounted on two preferably spaced apart, upright first and second weight guide shafts 56 and 58 extending through weight guide ports 16. The first and second weight guide shafts 56 and 58 extending between and are secured to first and second sides of the base frame 36 and the top frame 38. The weight 12 is preferably of stack of discrete weight plates 12, any desired number of which are selectable and can be isolated for lifting independently of any remaining weight plates 12. In this instance, cable distal end 62 is connected to an upright weight engaging rod 82 having a longitudinal series of weight key passing holes 84, the engaging rod 82 extending through an engaging rod port 86 in each weight plate 12, and a weight key 92 is fitted underneath the number of weight plates 12 selected for a given workout and into a corresponding engaging rod port 86, in a well-known configuration. A housing cover 94 is preferably fitted over the machine frame 30 upper end and around the pulley 32 to protect a user from injurious contact with machine 10 moving parts.

A substantially horizontal base plate 102 preferably rests on the ground G beneath the pedal 20 and is secured to first and second base plate legs 104 and 106 extending upward to leg brackets 112 and 114 connecting the base plate legs 104 and 106 to first and second proximal frame posts 42 and 26, respectively. Each base plate leg 104 and 106 is preferably tubular and has an upper end cap 108. A strut 116 extends between and connects the base plate legs 104 and 106 to enhance structural integrity.

First and second upright grip handles 122 and 124 preferably extend forwardly from the frame 30 upper end, above the pedal 20 on grip arms 126 and 128 which slidably pass through correspondingly located first and second leg brackets 112 and 114, for a machine 10 user to hold and brace himself or her self while pressing downwardly with a foot against the weight displacement pedal 20. Each grip arm 126 and 128 has a longitudinal guide keyway 132 into which a frame key 134 passes so that the grip arms 126 and 128 can slide forwardly and rearwardly but cannot rotate about their axes relative to the leg brackets 112 and 114, so that the grip handles 122 and 124 do not pivot out of their upright orientations. A grip arm pin screw 136 passes through each leg bracket 112 and 114 and releasibly enters any one of a longitudinal series of grip arm pin ports 142 in the corresponding grip arm 126 or 128 to secure the grip arm at a desired forward extension against longitudinal sliding during machine 10 use.

The pedal 20 preferably includes a tubular pedal support arm 24 formed of telescoping proximal and distal pedal support arm segments 24*a* and 24*b*, respectively. The pedal 20 is secured to the proximal pedal support arm segment 24*a* and the weight cable proximal end 64 is secured to the distal pedal support arm segment 24*b*. The pedal 20 is preferably mounted to the pedal support arm 24 on a horizontally oriented pin 20*a* so that the pedal 20 is pivotable forwardly and rearwardly to any of several tilt positions relative to horizontal, and the pedal 20 is releasibly securable in each of these tilt positions with a set screw or other well known mechanical means to alter the nature of the exercise. The distal pedal support arm segment 24*b* includes a pedal guide tube 26 which slidably fits around the pedal guide shaft 22.

The pedal brake 70 preferably includes a brake arm pivot pin 74 about which first and second brake arms 76 and 78, respectively, pivot away from and into contact with opposing sides of the pedal guide shaft 22. See FIGS. 16, 17 and 17*a*. A spring 66 biases the brake arm free ends toward each other and into gripping contact with the pedal guide shaft 22, and the free end of each brake arm 76 and 78 has a brake pad P oriented toward the pedal guide shaft 22. A brake cable 80 having a cable sleeve 80*a* passes through a sleeve mount 96 secured to a brake arm extension 76*a* of the first brake arm 76 and is secured to a brake cable mount 98 secured to the second brake arm 78. Pressing the weight displacement pedal 20 causes the brake cable 80 to be pulled back into the cable sleeve 80*a* and thus lengthens the free length of the brake cable 80. This releases any biasing force on the brake pads P. In the rest state, the brake cable 80 is pulled away from the sleeve 80*a* by the spring 66 and the swing rod 88.

To use exercise machine 10, one simply faces machine 10, grips the grip handles 122 and 124 with each hand, places one foot onto the pedal 20, and presses pedal 20 downwardly against the resistance of the lifting of the weight(s) 12 and then raises his or her foot and the pedal 20, and repeats this cycle as many times as desired for one set of repetitions ("reps"). Then the user places his or her other foot on the pedal 20 and repeats this method. The user foot not on pedal 20 preferably rests on top of base plate 102 during machine use.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An exercise machine for exercising the hamstrings, comprising:

at least one weight;

a weight support surface below said weight;

an upright pedal guide shaft;

a weight displacement pedal slidably mounted to said pedal guide shaft;

a machine frame;

pulley means secured to said machine frame at a position higher than said weight and higher than said weight displacement pedal and laterally between said weight and said pedal guide shaft;

a cable extending over and riding on said pulley means and having a cable distal end secured to said weight and having a cable proximal end secured to said weight displacement pedal, said cable being of a length such that when said weight rests on said weight support surface said weight displacement pedal is elevated;

and a pedal brake positioned adjacent to said pedal guide shaft and biased with brake engagement biasing means to engage said pedal guide shaft and including a brake disengagement mechanism operatively connected to said pedal which releases said pedal guide shaft upon application of downward force on said weight displacement pedal against the biasing of said brake engagement biasing means.

2. The exercise machine of claim 1, wherein said machine frame comprises:

a parallelepipped structure having a generally horizontal rectangular base frame, a generally horizontal rectangular top frame spaced above said base frame and laterally spaced apart upright frame posts interconnecting said base frame and said top frame.

3. The exercise machine of claim 2, wherein said frame posts comprise a first proximal frame post and a first distal frame post and a second proximal frame post and a second distal frame post.

4. The exercise machine of claim 3, wherein said pulley means comprises a generally horizontal pulley axle and a pulley mounted on said pulley axle such that said pulley is rotatable relative to said machine frame, said exercise machine additionally comprising a first pulley mounting member interconnecting and secured to said first proximal frame post and said first distal frame post, and a second pulley mounting member interconnecting and secured to said second proximal frame post and said second distal frame post, wherein said pulley axle extends between and is secured relative to said first pulley mounting member and said second pulley mounting member and passes through the center of said pulley, said pulley being positioned between said first pulley mounting member and said second pulley mounting member.

5. The exercise machine of claim 2, wherein said pedal guide shaft extends between and is secured to said base frame and said top frame.

6. The exercise machine of claim 2, wherein said weight comprises a weight guide port and is slidably mounted on an upright weight guide shaft extending through said weight guide port, said weight guide shaft extending between and being secured to said base frame and said top frame.

7. The exercise machine of claim 6, wherein said weight comprises a stack of discrete and separable weight plates and an upright plate engaging rod connected to said cable distal end and having a longitudinal series of weight key passing holes, said engaging rod extending through registering engaging rod ports in said weight plates, and a weight key fitted underneath a given number of said weight plates selected for lifting in a given workout and into a corresponding said engaging rod port.

8. The exercise machine of claim 2, additionally comprising a substantially horizontal base plate resting on the ground beneath said pedal, and base plate legs secured to said base plate and extending upwardly, and leg brackets connecting said base plate legs to two opposing said frame posts.

9. The exercise machine of claim 1, additionally comprising a housing cover fitted over said machine frame upper end and around said pulley means to protect a user from injurious contact with said pulley means and said cable.

10. The exercise machine of claim 1, comprising first and second grip handles secured relative to and extending from said frame upper end, above said weight displacement pedal.

11. The exercise machine of claim 10, additionally comprising:

a first grip arm connected to said first grip handle and a second grip arm connected to said second grip handle, said first and second grip arms extending forwardly from said frame;

first and second grip arm support structures comprising means for receiving and slidably passing said first and second grip arms respectively and comprising means for securing said first and second grip arms at any of various forward extensions.

12. An exercise machine for exercising the hamstrings, comprising:

at least one weight;

a weight support surface below said weight;

upright pedal guide means;

a weight displacement pedal slidably mounted to said pedal guide means;

a machine frame;

pulley means secured to said machine frame at a position higher than said weight and higher than said weight displacement pedal and laterally between said weight and said pedal guide shaft;

a cable extending over and riding on said pulley means and having a cable distal end secured to said weight and having a cable proximal end secured to said weight displacement pedal, said cable being of a length such that when said weight rests on said weight support surface said weight displacement pedal is elevated;

a first and second grip handles secured relative to and extending from said frame upper end, above said weight displacement pedal;

a first grip arm connected to said first grip handle and a second grip arm connected to said second grip handle, said first and second grip arms extending forwardly from said frame;

and first and second grip arm support structures comprising means for receiving and slidably passing said first and second grip arms respectively and comprising means for securing said first and second grip arms at any of various forward extensions;

wherein each said grip arm comprises a longitudinally extending grip arm keyway and wherein each said grip arm support structure comprises a grip arm frame key which fits into the corresponding said grip arm keyway for preventing rotation of each said grip arm about its longitudinal axis while permitting each said grip arm to slide longitudinally within the corresponding said grip arm support structure.

13. An exercise machine for exercising the hamstrings, comprising:

at least one weight;

a weight support surface below said weight;

an upright pedal guide shaft;

a weight displacement pedal slidably mounted to said pedal guide shaft;

a machine frame;

a generally horizontal pulley axle secured to said machine frame at a position higher than said weight and higher than said weight displacement pedal and laterally between said weight and said pedal guide shaft;

a pulley mounted on said pulley axle such that said pulley is rotatable relative to said machine frame;

a cable extending over and riding on said pulley and having a cable distal end secured to said weight and having a cable proximal end secured to said weight displacement pedal, said cable being of a length such that when said weight rests on said weight support surface said weight displacement pedal is elevated;

wherein said weight displacement pedal comprises a tubular pedal support arm formed of telescoping proximal and distal pedal support arm segments, wherein said weight displacement pedal is secured to said proximal pedal support arm segment and said cable proximal end is secured to said distal pedal support arm segment, said pedal distal support arm segment comprising a pedal guide tube slidably fitting around said pedal guide shaft, and comprising means for releasibly securing said proximal pedal support arm segment relative to said distal pedal support arm segment.

14. The exercise machine of claim 13, wherein said pedal is pivotally mounted to said pedal support arm such that said pedal is pivotable forwardly and rearwardly to any of a plurality of tilt positions relative to horizontal, said pedal support arm comprising pedal securing means for releasibly securing said pedal in each of these tilt positions.

15. An exercise machine for exercising the hamstrings, comprising:

at least one weight;

a weight support surface below said weight;

upright pedal guide means;

a weight displacement pedal slidably mounted to said pedal guide means;

a machine frame;

pulley means secured to said machine frame at a position higher than said weight and higher than said weight displacement pedal and laterally between said weight and said pedal guide means;

a cable extending over and riding on said pulley means and having a cable distal end secured to said weight and having a cable proximal end secured to said weight displacement pedal, said cable being of a length such that when said weight rests on said weight support surface said weight displacement pedal is elevated;

and a pedal brake adjacent said pedal guide means and biased with brake engagement biasing means to engage said pedal guide means.

* * * * *